US012256846B2

(12) United States Patent
Fan

(10) Patent No.: US 12,256,846 B2
(45) Date of Patent: Mar. 25, 2025

(54) BAMBOO SEAT AND BAMBOO STOOL

(71) Applicant: ZHENGHE RUICHANG ARTS & CRAFTS CO., LTD., Nanping (CN)

(72) Inventor: Bangrui Fan, Nanping (CN)

(73) Assignee: ZHENGHE RUICHANG ARTS & CRAFTS CO., LTD., Nanping (CN)

( * ) Notice: Subject to any disclaimer, the term of this patent is extended or adjusted under 35 U.S.C. 154(b) by 168 days.

(21) Appl. No.: 18/337,707

(22) Filed: Jun. 20, 2023

(65) Prior Publication Data

US 2024/0423370 A1 Dec. 26, 2024

(51) Int. Cl.

| | |
|---|---|
| ***A47C 5/00*** | (2006.01) |
| ***A47C 4/02*** | (2006.01) |
| ***A47C 4/03*** | (2006.01) |
| ***A47C 5/14*** | (2006.01) |
| ***A47C 7/02*** | (2006.01) |
| ***A47C 7/16*** | (2006.01) |
| ***A47C 9/00*** | (2006.01) |

(52) U.S. Cl.

CPC ..... *A47C 5/00* (2013.01); *A47C 4/021* (2013.01); *A47C 4/03* (2013.01); *A47C 5/14* (2013.01); *A47C 7/02* (2013.01); *A47C 7/16* (2013.01); *A47C 9/00* (2013.01)

(58) Field of Classification Search

CPC .. A47C 4/021; A47C 4/03; A47C 5/14; A47C 7/02; A47C 7/028; A47C 7/16

USPC ..... 297/452.63

See application file for complete search history.

(56) References Cited

U.S. PATENT DOCUMENTS

| | | | | | |
|---|---|---|---|---|---|
| 127,045 | A * | 5/1872 | Gardner | A47C 7/02 | 297/452.46 |
| RE7,202 | E * | 7/1876 | Gardner | 52/800.11 | |
| RE7,203 | E * | 7/1876 | Gardner | 297/452.46 | |
| RE9,094 | E * | 2/1880 | Gardner | 297/452.21 | |
| 1,895,210 | A * | 1/1933 | Schermerhorn | A47C 7/16 | 297/56 |
| 2012/0280550 | A1* | 11/2012 | College | F16B 12/26 | 403/345 |
| 2013/0175844 | A1* | 7/2013 | Noe | A47C 7/024 | 297/445.1 |
| 2013/0257130 | A1* | 10/2013 | Wang | A47C 5/00 | 297/411.2 |

* cited by examiner

*Primary Examiner* — Robert Canfield
(74) *Attorney, Agent, or Firm* — Daniel M. Cohn

(57) ABSTRACT

A bamboo seat and a bamboo stool are provided. The bamboo seat includes two side frames and bamboo piece components. The two side frames are spaced apart and are arranged from left to right. Each of the side frames extends from front to rear. Mortises are defined on an inner side surface of each of the side frames. The mortises defined on each of the side frames are arranged at intervals from front to rear. The bamboo piece components are arranged at intervals from front to rear. A gap is formed between every two adjacent bamboo piece components. Two ends of each of the bamboo piece components are respectively inserted into corresponding mortises on the two side frames to be tightly matched and fixed to the side frames. Each of the bamboo piece components is formed by stacking at least three bamboo pieces.

19 Claims, 4 Drawing Sheets

BAMBOO SEAT AND BAMBOO STOOL

TECHNICAL FIELD

The present disclosure relates to a technical field of furniture, and in particular to a bamboo seat and a bamboo stool.

BACKGROUND

Among sitting furniture, a folding stool appeared first, and the folding stool is a predecessor of a stool. The stool with a backrest has evolved into a chair. Foot stool or horse stool is a folk name of the stool, since the stool is originally used to step on a horse or a sedan chair. Further, the stool is also known as "martial stool", because martial art practitioners sit like a bell and do not need the backrest to lean on.

The stool is made of simple materials and has a wide range of uses, so it has been passed down in greater numbers than the chair. A shape of the stool is very rich. Until the Ming Dynasty, the shape of the stool is basically rectangular. By the Qing Dynasty, the stool became square, and there are also round, fan-shaped, plum-shaped, hexagonal, and other forms of stools.

Bamboo stool is one of the most common sitting furniture, which mainly consists of two support frames, two horizontal rods, and a seat. The two support frames are spaced apart from each other, and the two horizontal rods are arranged from front to rear and each of which is fixedly connected between the two support frames.

The seat comprises two side frames and a bamboo panel connecting the two side frames. The side frames are respectively fixed to top ends of the two support frames. The bamboo panel and the side frames of the seat of the bamboo stool are fixed through mortises and glue, which is not environmentally friendly. Moreover, a portion of the seat of the bamboo stool for sitting is the panel, which is hard, not comfortable enough and breathable enough. In addition, two ends of the bamboo panel of the bamboo stool are exposed outside the side frames after installation, which is easy to bump into when users use it and is not beautiful enough. Therefore, it is necessary to improve the bamboo stool in the prior art.

SUMMARY

In view of this, with regard to existing deficiencies of the prior art, a main purpose of the present disclosure is to provide a bamboo seat and a bamboo stool, which effectively solve a problem that a seat of a bamboo stool of the prior art is not environmentally friendly nor breathable enough.

To achieve the above purpose, the present disclosure provides the bamboo seat. The bamboo seat comprises two side frames and bamboo piece components.

The two side frames are spaced apart and are arranged from left to right. Each of the side frames extends from front to rear. Mortises are defined on an inner side surface of each of the side frames. The mortises defined on each of the side frames are arranged at intervals from front to rear. The bamboo piece components are arranged at intervals from front to rear. A gap is formed between every two adjacent bamboo piece components. Two ends of each of the bamboo piece components are respectively inserted into corresponding mortises on the two side frames to be tightly matched and fixed to the side frames. Each of the bamboo piece components is formed by stacking at least three bamboo pieces.

Optionally, the bamboo pieces are *Phyllostachys pubescens* pieces.

Optionally, the side frames are made of wood.

Optionally, each of the side frames is a first arc structure with an upward arch in a middle portion of the first arc structure. The mortises defined on each of the side frames are arranged along an arc of the first arc structure thereof.

Optionally, the mortises are evenly spaced.

Optionally, each of the bamboo piece components is a second arc-shaped structure with an upward arch in a middle portion of the second arc-shaped structure. Optionally, the mortises are square holes.

Optionally, every two adjacent bamboo piece components are arranged parallel to each other.

Optionally, there are eleven bamboo piece components.

Optionally, a width of each gap is less than a width of each of the bamboo piece components and is greater than half of the width of each of the bamboo piece components.

Optionally, a front end and a rear end of each of the side frames are arc-shaped and convex.

The present disclosure further provides the bamboo stool. The bamboo stool comprises two support frames, two horizontal rods, and the bamboo seat mentioned above. The two support frames are spaced apart from each other and are arranged from left to right. The two horizontal rods are arranged from front to rear. The horizontal rods fixedly connect the two support frames. Each of the side frames is arranged on a top end of a corresponding support frame of the support frames.

Optionally, the support frames are made of wood.

Optionally, the support frames comprise front support legs, rear support legs, and connecting rods. The front support legs and the rear support legs are arranged from front to rear. Each of the front support legs and a corresponding rear support leg form a splayed structure. A top end of each of the front support legs is fixedly connected to a front end of a corresponding side frame. A top end of each of the rear support legs is fixedly connected to a rear end of a corresponding side frame. Each of the connecting rods connects a lower end of a corresponding front support leg to a lower end of a corresponding rear support leg.

Optionally, a height of each of the horizontal rods is greater than a height of each of the connecting rods. Two ends of a first horizontal rod are respectively fixedly connected to inner sides of the front support legs of the two support frames. Two ends of a second horizontal rod are respectively fixedly connected to inner sides of the rear support legs of the two support frames.

Optionally, two fixing holes arranged from top to bottom are defined on each of the front support legs and each of the rear support legs. The two fixing holes on each of the front support legs penetrate each of the front support legs from an outer side surface to an inner side surface of each of the front support legs. The two fixing holes on each of the rear support legs penetrate each of the rear support legs from an outer side surface to an inner side surface of each of the rear support legs. A fixing bolt passes through a corresponding fixing hole to fixedly connect to one end of a corresponding horizontal rod.

Optionally, the front support legs, the rear support legs, and the connecting rods are square wooden bars.

Optionally, the two horizontal rods are square wooden bars.

Optionally, the front end and the rear end of each of the side frames extend downward to from two projections. Bottom surfaces of the two projections of each of the side frames are respectively fixedly assembled with a top surface of a corresponding front support leg and a top surface of a corresponding rear support leg.

Optionally, a thickness of each of the horizontal rods is less than a thickness of each of the front support legs, a thickness of each of the rear support legs, and a thickness of each of the connecting rods.

Compared with the prior art, the bamboo seat comprises the bamboo piece components. At least three bamboo pieces are stacked in sequence to from one bamboo piece component of the bamboo piece components. The bamboo piece components are fixed directly through the mortises and no glue is needed. A production process of the bamboo seat is environmentally friendly, and the bamboo seat is flexible and is able to support great weight. Each gap is form between very two adjacent bamboo piece components, which improves breathability of the bamboo seat when using and provide good comfort. In addition, two ends of each of the bamboo piece components are installed in the side frames and are not exposed, making two sides of the bamboo seat smooth and beautiful.

Figure 1:
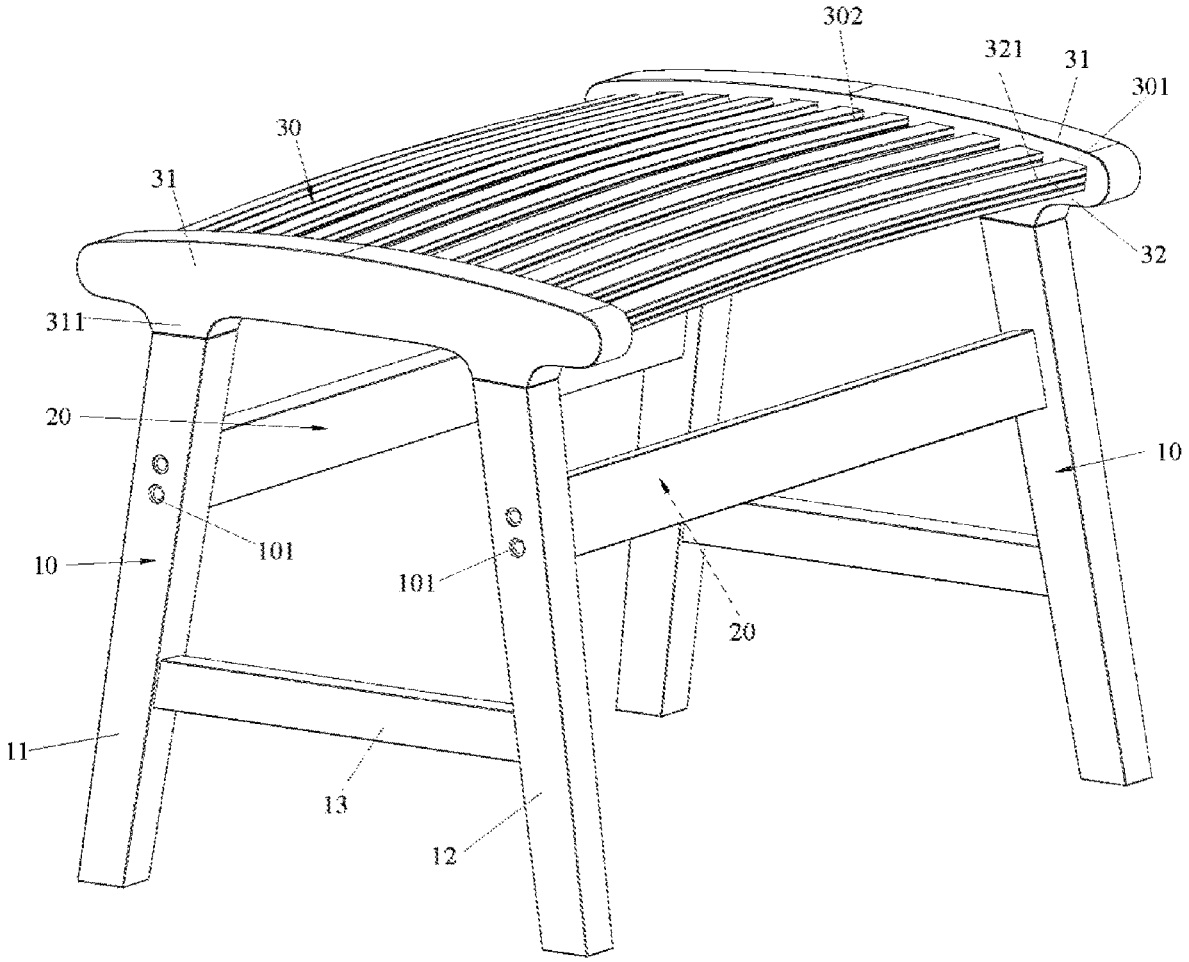
FIG. 1 is a perspective schematic diagram of a bamboo stool according to one optional embodiment of the present disclosure.

In the drawings: 10—support frame 11—front support leg; 12—rear support leg; 13—connecting rod; 101—fixing hole 20—horizontal rod; 30—bamboo-seat; 31—side frame; 311—projection; 32—bamboo piece component; 321—bamboo piece; 301—mortise; 302—gap.

DETAILED DESCRIPTION

Figure 2:
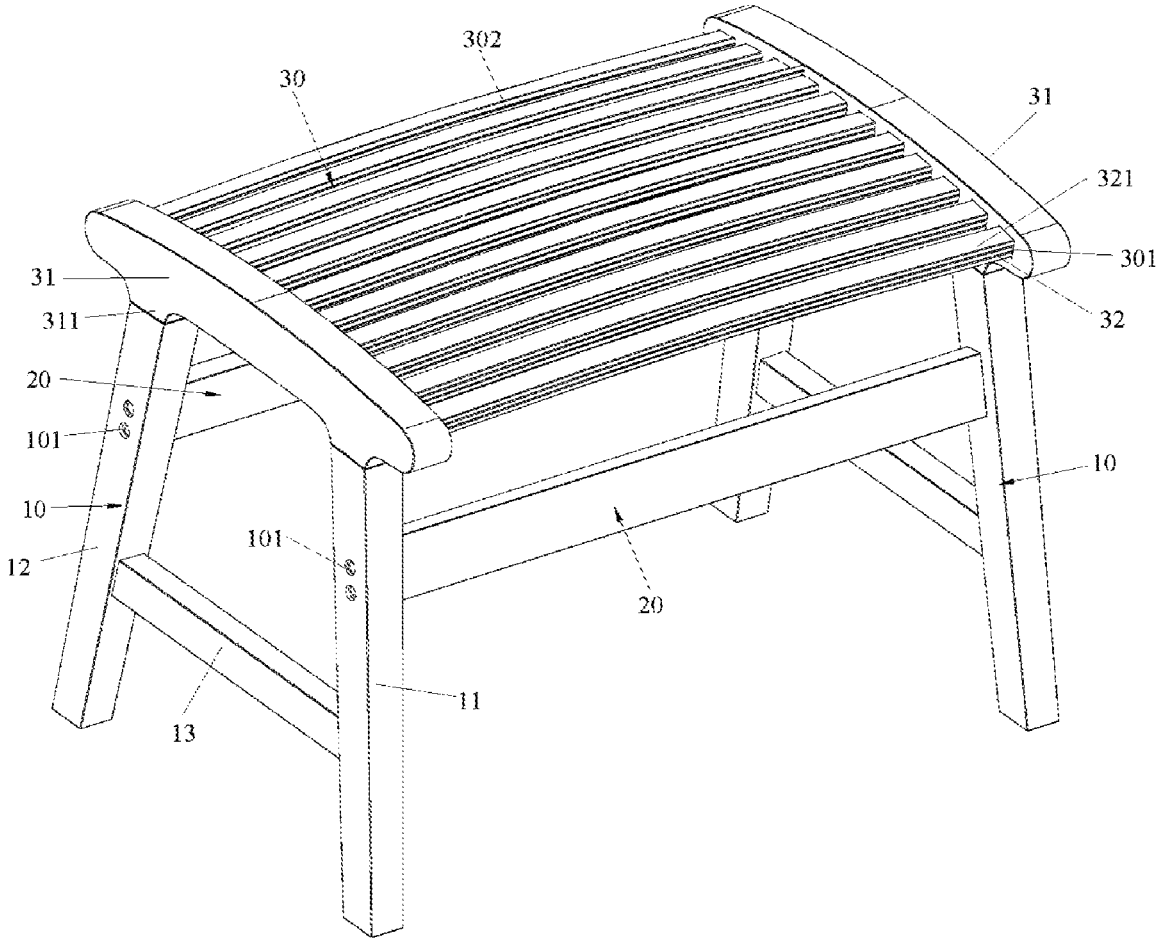
FIG. 2 is another perspective schematic diagram of the bamboo stool according to one optional embodiment of the present disclosure.
Figure 3:
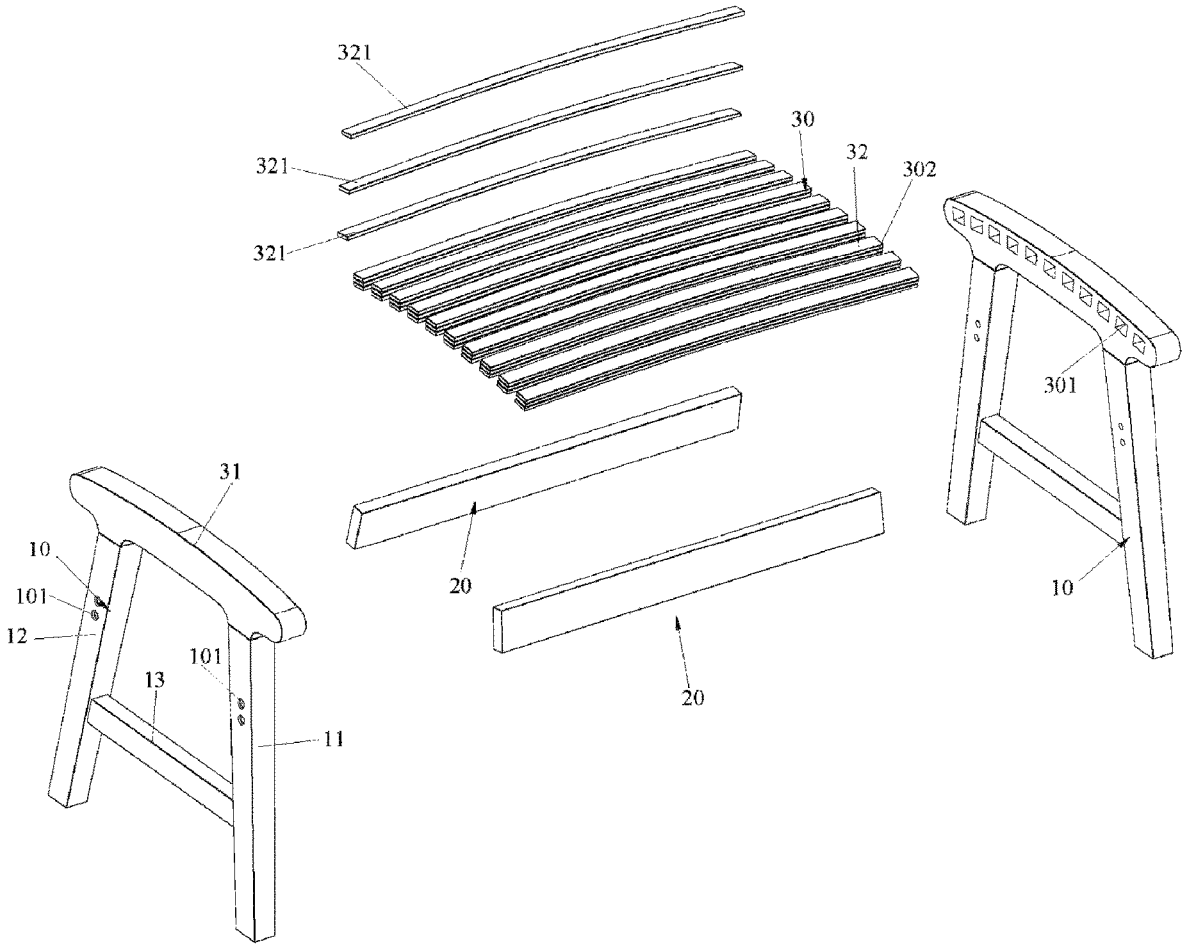
FIG. 3 is an exploded schematic diagram of the bamboo stool according to one optional embodiment of the present disclosure.
Figure 4:
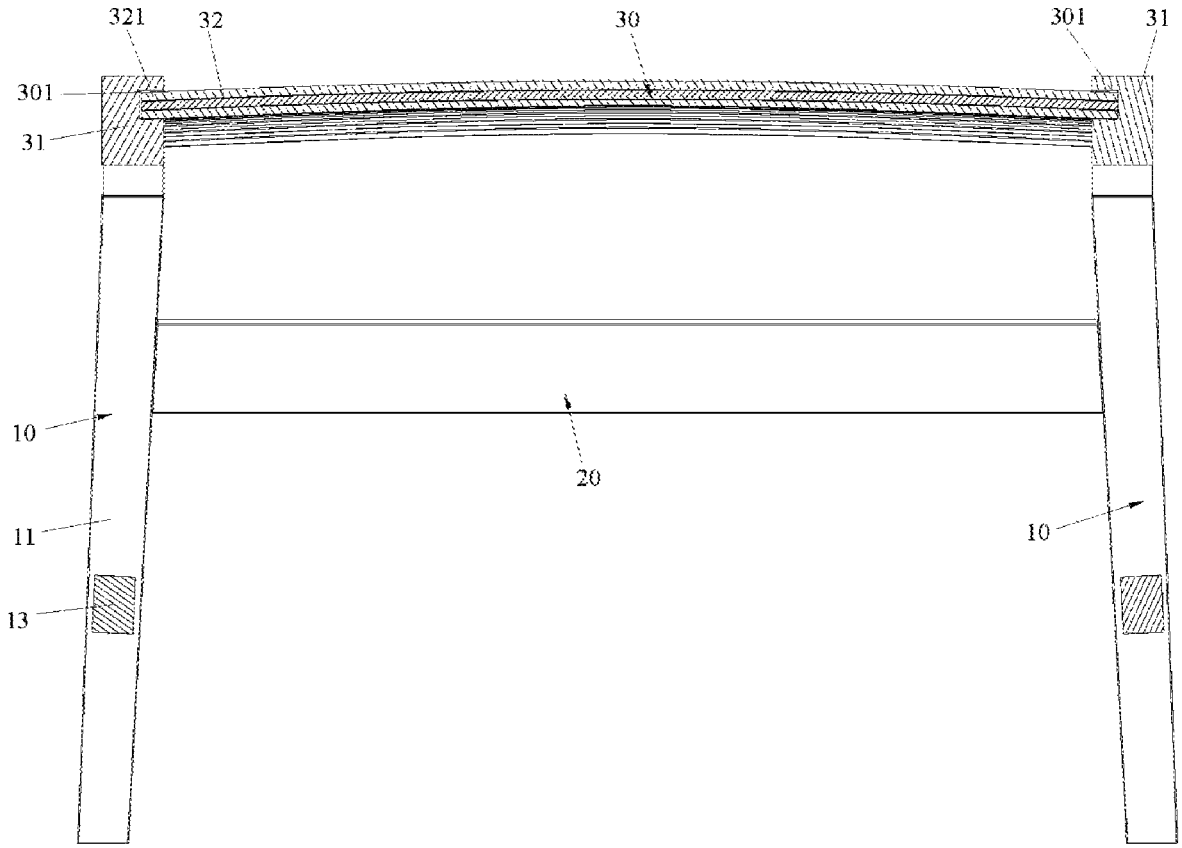
FIG. 4 is a cross-sectional schematic diagram of the bamboo stool according to one optional embodiment of the present disclosure.

As shown in FIGS. 1-4, a specific structure of a bamboo stool according to one optional embodiment of the present disclosure is shown. The bamboo stool comprises two support frames 10, two horizontal rods 20, and a bamboo seat 30.

The two support frames 10 are spaced apart from each other and are arranged from left to right. In the embodiment, the two support frames 10 are made of wood or other materials, which is not limited thereto. Specifically, the support frames 10 comprise front support legs 11, rear support legs 12, and connecting rods 13. The front support legs 11 and the rear support legs 12 are arranged from front to rear. Each of the front support legs 11 and a corresponding rear support leg 12 form a splayed structure. Each of the connecting rods 13 connects a lower end of a corresponding front support leg 11 to a lower end of a corresponding rear support leg 12. The front support legs 11, the rear support legs 12, and the connecting rods 13 are square wooden bars.

The two horizontal rods 20 are arranged from front to rear. The horizontal rods 20 fixedly connect the two support frames 10. A height of each of the horizontal rods 20 is greater than a height of each of the connecting rods 13. Two ends of a first horizontal rod 20 are respectively fixedly connected to inner sides of the front support legs 11 of the two support frames 10. Two ends of a second horizontal rod 20 are respectively fixedly connected to inner sides of the rear support legs 12 of the two support frames 10. A thickness of each of the horizontal rods 20 is less than a thickness of each of the front support legs 11, a thickness of each of the rear support legs 12, and a thickness of each of the connecting rods 13.

Two fixing holes 101 arranged from top to bottom are defined on each of the front support legs 11 and each of the rear support legs 12. The two fixing holes 101 on each of the front support legs 11 penetrate each of the front support legs 11 from an outer side surface to an inner side surface of each of the front support legs 11. The two fixing holes 101 on each of the rear support legs 12 penetrate each of the rear support legs 12 from an outer side surface to an inner side surface of each of the rear support legs. A fixing bolt (not shown in the drawings) passes through a corresponding fixing hole 101 to fixedly connect to one end of a corresponding horizontal rod 20, making connection thereof stable and reliable. Further, the two horizontal rods are square wooden bars, which are stable and reliable in structure.

The bamboo seat 30 comprises two side frames 31 and bamboo piece components 32. The side frames 31 are spaced apart and are arranged from left to right. Each of the side frames 31 extends from front to rear.

Mortises 301 are defined on an inner side surface of each of the side frames 31. The mortises 301 defined on each of the side frames are arranged at intervals from front to rear. The bamboo piece components 32 are arranged at intervals from front to rear. A gap 302 is formed between every two adjacent bamboo piece components 32, which improves breathability during use. Two ends of each of the bamboo piece components 32 are respectively inserted into corresponding mortises 301 on the two side frames 31 to be tightly matched and fixed to the side frames 31. Each of the bamboo piece components 32 is formed by stacking at least three bamboo pieces 321. The bamboo seat is installed by hand, eliminating use of glue by a conventional fixing method, effectively reducing carbon emissions and is environmental friendly. Further, the bamboo piece components 32 are installed in the side frames 31, so two ends of each of the bamboo piece components 32 are not exposed, making two sides of the bamboo seat smooth and beautiful. Each of the side frames 31 is arranged on a top end of a corresponding support frame 10 of the support frames 10. Specifically, a top end of each of the front support legs 11 is fixedly connected to a front end of a corresponding side frame 31. A top end of each of the rear support legs is fixedly connected to a rear end of a corresponding side frame 31.

In the embodiment, the side frames 31 are made of wood. Each of the side frames 31 is a first arc structure with an upward arch in a middle portion of the first arc structure. The mortises 301 defined on each of the side frames 31 are arranged along an arc of the first arc structure thereof. The mortises 301 are evenly spaced. The mortises 301 are square holes. The front end and the rear end of each of the side frames 31 are arc-shaped and convex. The front end and the rear end of each of the side frames 31 extend downward to from two projections 311. Bottom surfaces of the two projections 311 of each of the side frames 31 are respectively fixedly assembled with a top surface of a corresponding front support leg 11 and a top surface of a corresponding rear support leg 12.

Each of the bamboo piece components 32 is a second arc-shaped structure with an upward arch in a middle portion of the second arc-shaped structure. Since the bamboo piece components 32 are arc-shaped, the bamboo piece components 32 are blocked by the mortises 301 when stressed, preventing the bamboo piece components 32 from moving downwards to fall off the mortises 301. Every two adjacent bamboo piece components 32 are arranged parallel to each other. Further, there are eleven bamboo piece components 32. Of course, the number of the bamboo piece components is not limited thereto.

A width of each gap is less than a width of each of the bamboo piece components 32 and is greater than half of the width of each of the bamboo piece components 32. The bamboo pieces are *Phyllostachys pubescens* pieces. The bamboo piece component fully and reasonably applies characteristics of the *Phyllostachys pubescens*. Bamboo fiber of the *Phyllostachys pubescens* has elasticity, which not only ensures the bearing capacity of the bamboo seat, but also make a surface of the human body contacting the bamboo seat comfortable.

When assembly, at least three bamboo pieces 321 are stacked together to form one bamboo piece component 32, and then rest bamboo piece components 32 are prepared similarly. Then, the two ends of each of the bamboo piece components 32 are respectively inserted into corresponding mortises 301 on the two sides frame 31, so as to assemble the bamboo seat 30. The two support frames 10 are assembled and prepared, and then the two horizontal rods 20 each connects the two support frames 10. Finally, each of the side frames 31 of the bamboo seat 30 are fixed on the top end of the corresponding support frames 10.

In the present disclosure, the bamboo seat comprises the bamboo piece components. At least three bamboo pieces are stacked in sequence to from one bamboo piece component of the bamboo piece components. The bamboo piece components are fixed directly through the mortises and no glue is needed. A production process of the bamboo seat is environmentally friendly, and the bamboo seat is flexible and is able to support great weight. Each gap is form between very two adjacent bamboo piece components, which improves the breathability of the bamboo seat when using and provide good comfort. In addition, two ends of each of the bamboo piece components are installed in the side frames and are not exposed, making two sides of the bamboo seat smooth and beautiful.

The above are only optional embodiments of the present disclosure and specifically depict technical principles of the present disclosure. These descriptions are only for explaining the principles of the present disclosure, and cannot be interpreted as limiting of the protection scope of the present disclosure in any way. Based on the explanations, other specific implementations of the present disclosure obtained by those skilled in the art without creative work should fall within the protection scope of the present disclosure.

What is claimed is:

1. A bamboo seat, comprising:

two side frames, and bamboo piece components;

wherein the two side frames are spaced apart and are arranged from left to right; each of the side frames extends from front to rear; mortises are defined on an inner side surface of each of the side frames; the mortises defined on each of the side frames are arranged at intervals from front to rear; the bamboo piece components are arranged at intervals from front to rear; a gap is formed between every two adjacent bamboo piece components; two ends of each of the bamboo piece components are respectively inserted into corresponding mortises on the two side frames to be tightly matched and fixed to the side frames; each of the bamboo piece components is formed by stacking at least three bamboo pieces wherein the mortises are evenly spaced.

2. The bamboo seat according to claim 1, wherein the bamboo pieces are *Phyllostachys pubescens* pieces.

3. The bamboo seat according to claim 1, wherein the side frames are made of wood.

4. The bamboo seat according to claim 1, wherein each of the side frames is a first arc structure with an upward arch in a middle portion of the first arc structure; the mortises defined on each of the side frames are arranged along an arc of the first arc structure thereof.

5. The bamboo seat according to claim 1, wherein each of the bamboo piece components is a second arc-shaped structure with an upward arch in a middle portion of the second arc-shaped structure.

6. The bamboo seat according to claim 1, wherein the mortises are square holes.

7. The bamboo seat according to claim 1, wherein every two adjacent bamboo piece components are arranged parallel to each other.

8. The bamboo seat according to claim 1, wherein there are eleven bamboo piece components.

9. The bamboo seat according to claim 1, wherein a width of each gap is less than a width of each of the bamboo piece components and is greater than half of the width of each of the bamboo piece components.

10. The bamboo seat according to claim 1, wherein a front end and a rear end of each of the side frames are arc-shaped and convex.

11. A bamboo stool, comprising:

two support frames, two horizontal rods, and the bamboo seat according to claim 1;

wherein the two support frames are spaced apart from each other and are arranged from left to right; the two horizontal rods are arranged from front to rear; the horizontal rods fixedly connect the two support frames; each of the side frames is arranged on a top end of a corresponding support frame of the support frames.

12. The bamboo stool according to claim 11, wherein the support frames are made of wood.

13. The bamboo stool according to claim 12, wherein the support frames comprise front support legs, rear support legs, and connecting rods; the front support legs and the rear support legs are arranged from front to rear; each of the front support legs and a corresponding rear support leg form a splayed structure; a top end of each of the front support legs is fixedly connected to a front end of a corresponding side frame; a top end of each of the rear support legs is fixedly connected to a rear end of a corresponding side frame; each of the connecting rods connects a lower end of a corresponding front support leg to a lower end of a corresponding rear support leg.

14. The bamboo stool according to claim 13, wherein a height of each of the horizontal rods is greater than a height of each of the connecting rods; two ends of a first horizontal rod are respectively fixedly connected to inner sides of the front support legs of the two support frames; two ends of a second horizontal rod are respectively fixedly connected to inner sides of the rear support legs of the two support frames.

15. The bamboo stool according to claim 14, wherein two fixing holes arranged from top to bottom are defined on each of the front support legs and each of the rear support legs; the two fixing holes on each of the front support legs penetrate each of the front support legs from an outer side surface to an inner side surface of each of the front support legs; the two fixing holes on each of the rear support legs penetrate each of the rear support legs from an outer side surface to an inner side surface of each of the rear support legs; a fixing bolt passes through a corresponding fixing hole to fixedly connect to one end of a corresponding horizontal rod.

16. The bamboo stool according to claim 13, wherein the front support legs, the rear support legs, and the connecting rods are square wooden bars.

17. The bamboo stool according to claim 13, wherein the two horizontal rods are square wooden bars.

18. The bamboo stool according to claim 13, wherein the front end and the rear end of each of the side frames extend downward to from two projections; bottom surfaces of the two projections of each of the side frames are respectively fixedly assembled with a top surface of a corresponding front support leg and a top surface of a corresponding rear support leg.

19. The bamboo stool according to claim 13, wherein a thickness of each of the horizontal rods is less than a thickness of each of the front support legs, a thickness of each of the rear support legs, and a thickness of each of the connecting rods.

* * * * *